United States Patent [19]

Hayes

[11] 4,311,237

[45] Jan. 19, 1982

[54] FOOD CARRYING AND DISPLAY CONTAINER SYSTEM

[76] Inventor: John C. Hayes, 8316 Lager La., Baltimore, Md. 21207

[21] Appl. No.: 130,384

[22] Filed: Mar. 14, 1980

[51] Int. Cl.[3] ..... B65D 21/02; B65D 6/24; B65D 8/14

[52] U.S. Cl. ..... 206/503; 211/128; 206/820; 206/203; 220/4 A; 220/4 D; 220/72

[58] Field of Search ..... 220/4 A, 4 D, 72; 206/203, 820, 503; 211/128, 129; 312/252, 202, 197; 224/48 R, 131; 108/91, 94, 95, 96

[56] References Cited

U.S. PATENT DOCUMENTS

| | | | |
|---|---|---|---|
| 852,566 | 5/1907 | Lane | 220/4 A |
| 1,703,340 | 2/1929 | Grennan | 211/129 |
| 2,198,158 | 4/1940 | Fletcher | 220/4 A |
| 2,507,951 | 5/1950 | Barnes | 211/129 |
| 3,144,016 | 8/1964 | Basci | 220/4 D |
| 3,262,668 | 7/1966 | Luker | 229/3.5 MF |
| 3,273,739 | 9/1966 | Wei | 220/4 D |
| 3,474,928 | 10/1969 | Hartt | 220/72 |
| 3,951,079 | 4/1976 | Tolleson | 224/48 R |

FOREIGN PATENT DOCUMENTS

| | | | |
|---|---|---|---|
| 4751 | of 1926 | Australia | 211/128 |
| 748380 | 7/1933 | France | 211/128 |
| 1 396015 | 3/1965 | France | 206/503 |
| 543014 | 2/1942 | United Kingdom | 206/503 |

*Primary Examiner*—George E. Lowrance
*Attorney, Agent, or Firm*—John F. McClellan, Sr.

[57] ABSTRACT

A food carrying and display system includes a plurality of containers having one top and supportable in vertical array by stacking means including a coaxially disposed adjustable-length elongate screw provision; each container has a rim and a central spacer protecting the rim from distortion, both of which optionally may be detachable for cleaning and for ease in manufacturing, by use of an extra spacer and a single elongate screw and the top as few as one container can be carried with the top protectively in place sealing it closed; special carrying and handling provisions include a ring nut at the top of the assembly and around each container at mid-height a safety flange.

4 Claims, 7 Drawing Figures

FOOD CARRYING AND DISPLAY CONTAINER SYSTEM

This invention relates generally to containers and specifically to multi-level containers with variable capacity.

PRIOR ART

Containers of the general multi-level type have been disclosed in the following U.S. Pat. Nos.:

4,026,417 to E. H. Streim et al., 5-31-77, disclosed a vertically tapered array of display platforms;

4,011,954 to G. Galli, 3-15-77, disclosed a vertical array of discs separated by individual spacers;

2,605,187 to G. W. Stiehm, 7-29-52, disclosed a vertical multi-layer rack for use in a container; and 1,662,044 to G. O. Sanborn, 3-6-26, disclosed a vertical stacking apparatus.

SOME OBJECTS OF THIS INVENTION

However, none of the prior art is of such convenience, economy and utility as to have become the standard of commerce for purposes such as those set forth herein, and to provide such is a principal object of this invention.

Further objects are to provide a system as described which permits the protective carrying and display of food such as hamburgers, crabcakes, doughnuts and the like, in any chosen number of layers from one to perhaps a dozen or more, without danger of loss or spillage or exposure to insects, and yet which provides convenient inspection and ready access, and which is attractive in appearance.

Still further objects are to provide a system as described which is lightweight, strong and self-reinforcing, which is easy to use and to clean after use, and which requires only a few different parts and employs these interchangeably.

BRIEF SUMMARY OF THE INVENTION

In brief summary given as cursory description only and not as limitation the invention includes a food carriage and display system having a plurality of similar containers with central apertures permitting support and carriage of a variable number of the containers in mutually sealing spacing by a central stem of variable length and core spacers; detachable rims and cores for the containers permit ready cleaning as an option; materials can be transparent or opaque.

The above and other objects and advantages of the invention will become more readily understood on examination of the following descriptions, including the drawings in which like reference numerals refer to like parts.

BRIEF DESCRIPTION OF THE FIGURES

FIG. 1 shows the invention in first embodiment 10. Included are a plurality of containers 20 in the form of flat-bottom pans, each with a fixed peripheral rim 22 having around it a planar flange 24 radially extending from an intermediate portion of the height thereof, assuring safe pickup of each pan individually when disassembled, without danger of touching the contents and being burned or of contaminating the contents.

Figure 1:
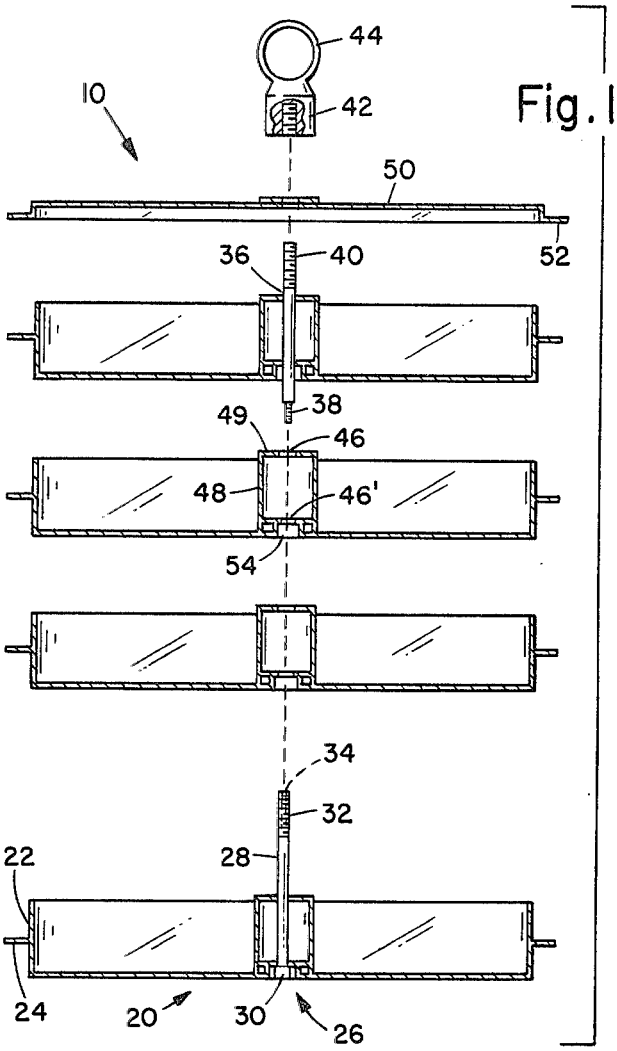
FIG. 1 is an elevational exploded view of a first embodiment, in partial section adapted from 1—1, FIG. 2.

For holding the containers in vertically stacked array, coaxial stacking means 26 are provided. These include as adjustable-length coupling means, an elongate axial screw assembly comprising plural screw-threaded parts: bolt 28 with hex head or other polygonal-shape head 30 at the bottom and both male thread 32 and female thread 34 at the upper end, mating threaded member 36 with male thread 38 at the lower end for engaging the female thread in the bolt and male thread 40 at the upper end for engaging lifting means or nut 42, and with ring 44 at the top for carrying and for tool-free assembly. Each container has a coaxial or central bore or hole 46, 46' with a tubular spacer 48 fixed therearound, through which the screw members pass. Transverse walls 49 stabilize the assembly. When compressed together by the coupling, the planar top 50 with downward periphery 52 seals against the rim of the container below it, and similarly each container below that seals against the bottom of the container above it. To prevent distortion of the containers under the compressive load, each spacer 48 protrudes slightly in height above the rim 22 of the respective container to share the load, and limit it on the rim. The bolt head and nut seal the central hole. Spacer height is exaggerated for clarity. Protrusion may be 0.010 inch (0.25 mm).

At least the bottom container (and preferably each container for interchangeability) has a polygonal-shape recess 54 for receiving and engaging the bolt head to prevent it from turning on assembly, providing for tool-free assembly. Preferably all containers are the same diameter and height.

A flexible feature of the invention is the adjustment in length of the screw-thread members, more or less of which can be used according to how many containers are to be used. The containers may be of metal although for display they, or at least the top and/or rims can be of transparent plastic cemented to assemble if necessary. A dozen or more containers of 2 inch (5 cm) preferred height can be employed safely. Each can carry in the preferred diameter of ten to twelve inches (25 cm to 30 cm) perhaps a dozen hamburgers, crabcakes, or doughnuts in sanitary but readily accessible protected storage, free from insects, dirt, dust and other contaminants. Emptied containers can be lifted free and the top restored. The holding planar flange 24 may be $\frac{1}{2}$ to $\frac{3}{4}$ inch (12 to 18 mm) wide and halfway up the height of the rim.

Figure 2:
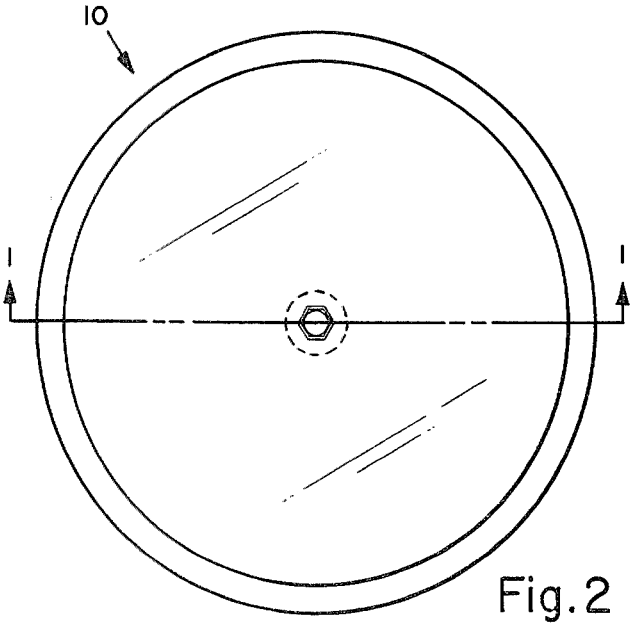
FIG. 2 is a bottom plan detail of FIG. 1.

FIG. 2 shows the bottom plan view of the embodiment 10.

Figure 3:
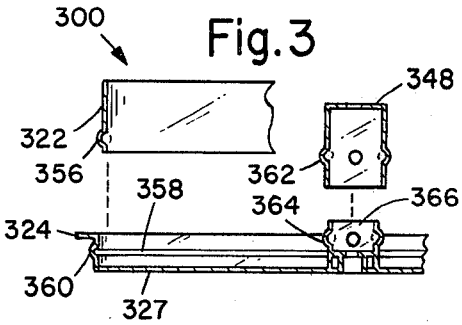
FIG. 3 is an elevational exploded view detail of a second embodiment, in partial section.

FIG. 3 shows an embodiment 300 differing from the first embodiment in that the rim 322 is detachable from the base 327 and the spacer 348 also, for cleaning and simplicity in manufacture. The rim has one or more local convolutions in the form of one or more protrusions 356 which detachably snap-fit into a circumferential groove 358 in a circular upright flange 360 around the perimeter of the base, which may be about half the height of the rim or less, so that at any orientation about the axis there will be positive resilient engagement and locking.

Similarly the spacer 348 has local convolution 362 which snap fits into a complementary convolution 364 in an upright tubular core 366. Both the spacer and the core may be rectangular in section in this embodiment, assuring positive mating of the convolutions if at least one is provided on each face of each part.

In this embodiment the planar or holding flange 324 is an integral radial protrusion of the upright flange.

Figure 4:
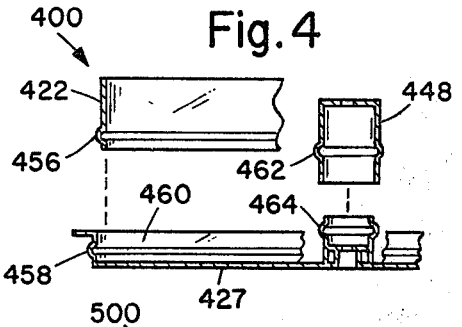
FIG. 4 is an elevational exploded view detail of a third embodiment, in partial section.

FIG. 4 shows a similar embodiment 400 in which rim 422 and upright flange 460 have respective circumferential, mating convolutions 456, 458 for locking detachably to the base 427. The spacer 448 which may be circular, and the core, circular also, have similar provisions 462, 464.

Figure 5:
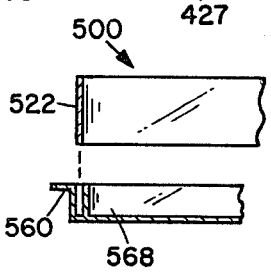
FIG. 5 is an elevational exploded view detail of a fourth embodiment, in partial section.

FIG. 5 shows a similar embodiment 500 in which a second coaxial ring or upright integral flange 568 is spaced from the first upright flange 560 a distance frictionally holding in the space between them, the rim 522.

Figure 6:
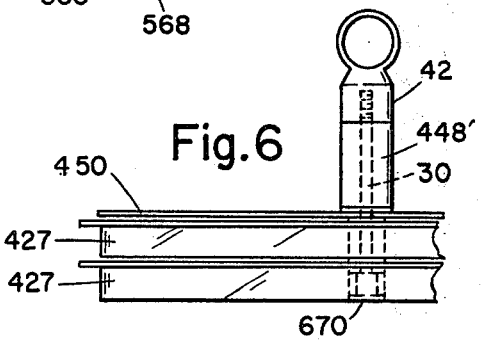
FIG. 6 is an elevational assembly detail of a fifth embodiment.

FIG. 6 shows how two bases 427 can be held using a planar disc-shaped top 450 and an additional spacer 448' above to complete the length of the bolt 30 for compression of the assembly. The bolt may be 4½ inches, (8.1 cm) long; this handily connects the container and a top. The other dimensions in this example being upright flange height 1 inch (2.5 cm), top height 1/16 inch (0.16 cm), spacer 2 inches (5 cm) high. The recess 670 in the bottom of the container just holding the bolt head flush should be in this case 15/16 inch (2.3 cm) deep. Diameter of the spacer may be 1½ inches (36 mm). (Crabcakes and hamburgers may be conventionally about one inch thick and doughnuts the same or greater).

Figure 7:
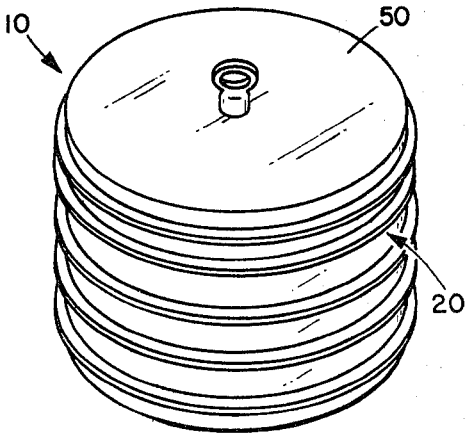
FIG. 7 is a perspective assembly view of the first embodiment.

FIG. 7 shows the exterior view of the complete assembly of a unit 10 according to this invention having four containers 20 and top 50.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In an array formed of a plurality of containers held in vertically spaced relation by stacking means coaxial therewith and adjustable with respect thereto and a top for the uppermost container, the improvement comprising:

a rim around each container;

the stacking means including: said top and each container having a hole centrally therethrough, a spacer on each container around the hole, coupling means passing through each said spacer and hole, each rim comprising a circular member on the container and safety pickup means on each container comprising a planar flange on the circular member radially protrusive from an intermediate portion thereof, a first cleaning provision comprising means detachably holding each rim, the means detachably holding including an upstanding flange fixed around the perimeter of each container and having protrusion for fitting said rim and further including means locking the rim to the upstanding flange, a second cleaning provision comprising means detachably holding each spacer, the means detachably holding each spacer comprising a tubular core fixed as part of each container, each spacer and tubular core having mutually engaging convolutions, the coupling means comprising means for sealing the rims of said containers and top including means for compressing together the rims of said containers and top, and means for preventing distortion of the containers on said compressing together, comprising said spacers having height proportioned for limiting said compression of the rims by sharing the load of said compression.

2. In array as recited in claim 1, each said spacer having a rectangular shape in cross section.

3. In an array as recited in claim 1, the locking means comprising on each container a fixed coaxial pair of upright flanges with spacing therebetween for frictionally retaining the rim.

4. In an array as recited in claim 1, the elongate means comprising a plurality of screw-thread inter-connectable axial members for varying the length of said elongate means.

* * * * *